US006557452B1

(12) United States Patent
Morroney et al.

(10) Patent No.: US 6,557,452 B1
(45) Date of Patent: May 6, 2003

(54) VALVE AND POSITION CONTROL SYSTEM INTEGRABLE WITH CLAMP

(75) Inventors: Wayne D. Morroney, Troy; Timothy E. Wheeler, Shelby Township, both of MI (US)

(73) Assignee: Norgren Automotive, Inc., DE (US)

( * ) Notice: Subject to any disclaimer, the term of this patent is extended or adjusted under 35 U.S.C. 154(b) by 0 days.

(21) Appl. No.: 09/614,954

(22) Filed: Jul. 12, 2000

Related U.S. Application Data

(60) Provisional application No. 60/144,322, filed on Jul. 16, 1999.

(51) Int. Cl.[7] ..... F15B 11/08
(52) U.S. Cl. ..... 91/465
(58) Field of Search ..... 91/465, 461, 1, 91/42, 462; 269/32

(56) References Cited

U.S. PATENT DOCUMENTS

| | | | | |
|---|---|---|---|---|
| 4,021,027 A | | 5/1977 | Blatt | 269/32 |
| 4,651,625 A | * | 3/1987 | Hoge | 91/461 |
| 4,665,699 A | * | 5/1987 | Krusche | 60/452 |
| 4,705,331 A | | 11/1987 | Britton | 439/387 |
| 4,865,301 A | | 9/1989 | Ise | 269/34 |
| 4,884,402 A | * | 12/1989 | Strenzke et al. | 60/426 |
| 4,923,184 A | * | 5/1990 | Schauss | 264/32 |
| 5,034,621 A | | 7/1991 | Groves et al. | 307/117 |
| 5,125,324 A | | 6/1992 | Araki et al. | 91/454 |
| 5,138,838 A | * | 8/1992 | Crosser | 91/461 |
| 5,188,411 A | | 2/1993 | Golden | 294/64.2 |
| 5,201,560 A | | 4/1993 | Golden | 294/64.2 |
| 5,330,168 A | | 7/1994 | Enomoto et al. | 269/329 |
| 5,365,827 A | * | 11/1994 | Morita | 91/1 |
| 5,696,177 A | | 12/1997 | Noguchi et al. | 269/24 |
| 5,819,783 A | | 10/1998 | Blatt et al. | 137/271 |
| 5,845,897 A | | 12/1998 | Tunkers | 269/32 |
| 5,875,417 A | | 2/1999 | Golden | 702/150 |

FOREIGN PATENT DOCUMENTS

| | | | |
|---|---|---|---|
| EP | 0 313 767 | 5/1989 | |
| EP | 0 406 530 A | 1/1991 | B25B/11/00 |
| EP | 0713 980 A2 | 5/1996 | |
| EP | 0 803 653 A1 | 10/1997 | |

OTHER PUBLICATIONS

Partia; European Search Report Nov. 20,201 EP 00 30 605.

* cited by examiner

*Primary Examiner*—Edward K. Look
*Assistant Examiner*—Thomas E. Lazo
(74) *Attorney, Agent, or Firm*—Young & Basile, P.C.

(57) ABSTRACT

A valve and position control system integrable with a clamp having at least one clamp arm moveable between a clamped position and a released position in response to movement of an actuator between first and second end limits of travel controlled by differential fluid pressure in first and second chambers located on opposite sides of the actuator. The system allows selective setting of at least one of the clamped position and the released position at an actuator position between the first and second end limits of travel of the actuator. The system selectively controls the speed of actuator movement as the actuator moves between the first and second end limits of travel. Preferably, the system also selectively controls the speed of actuator movement as the actuator approaches at least one of the first and second end limits of travel to provide a soft touch clamp action. The system selectively adjusts pressurized fluid within the first and second chambers independent of one another.

56 Claims, 7 Drawing Sheets

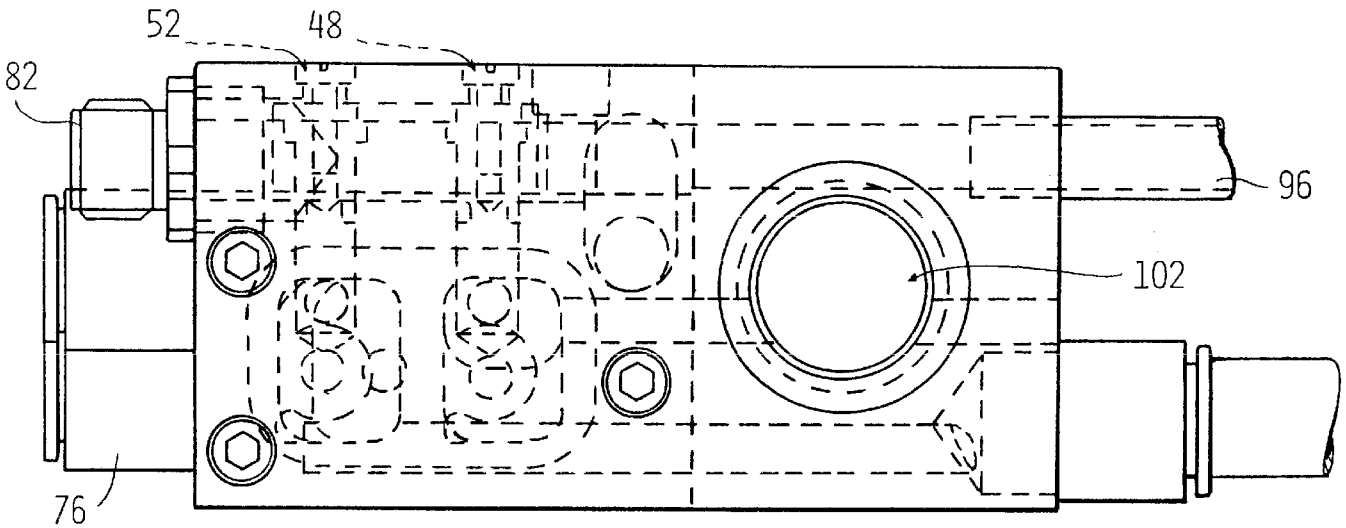
FIG 5(d)(1)
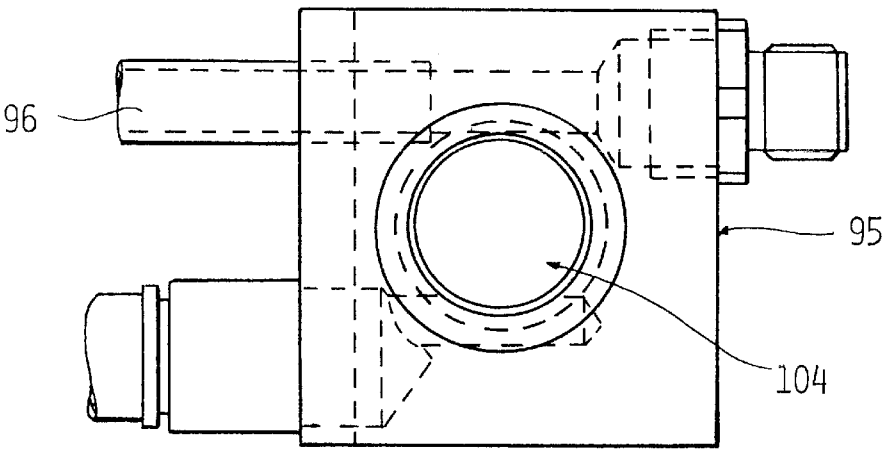
FIG 5(d)(2)

VALVE AND POSITION CONTROL SYSTEM INTEGRABLE WITH CLAMP

CROSS-REFERENCES TO RELATED APPLICATIONS

This application claims the benefit of U.S. Provisional Application No. 60/144,322, filed Jul. 16, 1999.

FIELD OF THE INVENTION

The present invention relates to industrial clamps having at least one pivotal arm.

BACKGROUND OF THE INVENTION

FIG. 1 is a perspective view of a typical valve and cylinder system 8 which is common in the art of industrial clamps. In particular, there is a hollow cylinder 10 having a first end 14 and a second end 16. Within the cylinder 10, there is a piston (not shown) which is movable between a first end position and a second end position. The piston is connected to a rod 12 that protrudes through the second end 16. The rod 12 is typically connected to a linkage assembly (not shown) to which a shaft (not shown) is rotatably connected. A clamp arm (not shown) is then typically fixedly mounted on the shaft.

At or near both the first end 14 and the second end 16 of the cylinder 10 are two proximity switches 18. These two proximity switches 18 serve to provide an indirect indication of the rotational position of the clamp arm by detecting whether the piston (or rod 12) is at the first end position (retracted position) or the second end position (extended position). Typically, the cylinder 10, in combination with the proximity switches 18, requires one or more electrical power and/or control cables 19.

The rod 12 and the piston (not shown) together define a full bore area (not shown) and an annulus area (not shown) on opposite sides of the piston within the cylinder 10. From the full bore and annulus two areas within the cylinder 10, a first air line 20 and a second air line 22 are routed to an air valve system 24 which is located remote from the cylinder 10.

The air valve system 24 typically has one or more exhaust ports in which one or more silencers 26 are fitted. In addition, the air valve system 24 typically has a main pneumatic air supply line 28 and an electrical power and/or control cable 30.

The typical valve and cylinder system 8, as described above, has certain drawbacks. First, for example, the remote location of the air valve system 24 from the cylinder 10 can create undesired difficulties if local control of the cylinder 10 and the associated clamp arm is desired. Second, the remote location of the air valve system 24 from the cylinder 10 also, in many instances, unnecessarily dictates the combined need for a multiplicity of electrical power and/or control cables and air lines at the two separate locations. The unnecessary multiplicity of electrical power and/or control cables can be especially troublesome in a manufacturing environment wherein many clamps are used simultaneously. Third, the remote location of the air valve system 24 from the cylinder 10 also unnecessarily creates additional problems for the combined servicing and repair of the cylinder 10 and the air valve system 24 at the two separate locations. Fourth, the remote location of the air valve system 24 from the cylinder 10 uses only approximately 20% of the compressed air in the system 8.

Thus, there is a present need in the art for eliminating the drawbacks and problems associated with the cylinder and the air valve system being at locations which are remote from each other.

SUMMARY OF THE INVENTION

In a clamp having at least one clamp arm moveable between a clamped position and a released position in response to movement of an actuator between first and second end limits of travel, the present invention provides means for selectively setting at least one of the clamped position and the released position at an actuator position between the first and second end limits of travel of the actuator.

In a clamp having at least one clamp arm moveable between a clamped position and a released position in response to movement of an actuator between first and second end limits of travel, the present invention provides means for selectively controlling a speed of actuator movement as the actuator moves between the first and second end limits of travel. Preferably, the present invention further provides means for selectively controlling the speed of actuator movement as the actuator approaches at least one of the first and second end limits of travel to provide a soft touch clamp action.

In a clamp having at least one clamp arm moveable between a clamped position and a released position in response to movement of an actuator controlled by differential fluid pressure in first and second chambers located on opposite sides of the actuator, the present invention provides means for selectively adjusting pressurized fluid within the first and second chambers independent of one another.

In a clamp network system having a plurality of clamps actuated in response to pressurized fluid, the present invention provides each of the plurality of clamps with a separate valve and position control system.

The present invention also provides a valve and position control system which is integrable with an industrial clamp. The valve and position control system, according to the present invention, is integrable with a clamp which has a main housing, a hollow cylinder having a first end and a second end mounted within the main housing, and a piston movable between a first end position and a second end position within the hollow cylinder. The clamp further includes a rod connected to the piston and protruding from the second end of the hollow cylinder, defining a full bore area and an annulus area on opposite sides of the piston within the hollow cylinder. In addition, the clamp includes a linkage assembly coupled to the rod and mounted within the main housing, a shaft rotatably connected to the linkage assembly, a clamp arm fixedly mounted on the shaft outside of the main housing, means for sensing the position of the clamp arm, and means for sensing the air pressure within the hollow cylinder. The valve and position control system, according to the basic embodiment of the present invention, is intended to be integrable with this type of clamp.

In a basic embodiment of the present invention, the integrable valve and position control system includes a complementary housing which is integrable with the main housing of the clamp. This complementary housing has an air supply port, an exhaust port, and an electronic interface port. In addition, the integrable valve and position control system includes a first direction control valve having three ports and two positions. This first direction control valve is capable of selectively and pneumatically connecting the full bore area of the hollow cylinder to one of either the air supply port or the exhaust port. The first direction control valve is mounted within the complementary housing. In addition to the first direction control valve, the integrable valve and position control system also includes a second direction control valve having three ports and two positions. This second direction control valve is capable of selectively and pneumatically connecting the annulus area of the hollow cylinder to one of either the air supply port or the exhaust port. The second direction control valve is mounted within the complementary housing.

According to the basic embodiment of the present invention, the integrable valve and position control system also includes first means for pneumatically piloting the first direction control valve. This first pneumatic piloting means is mounted within the complementary housing. In addition to the first pneumatic piloting means, the integrable valve and position control system also includes second means for pneumatically piloting the second direction control valve. This second pneumatic piloting means is also mounted within the complementary housing.

Further according to the basic embodiment of the present invention, the integrable valve and position control system also includes an electronic control circuit mounted within the complementary housing. This electronic control circuit is electrically connected to the first pneumatic piloting means, the second pneumatic piloting means, and the electronic interface port. In addition, this electronic control circuit is also electrically connectible to the clamp arm position sensing means and to the air pressure sensing means.

According to the basic embodiment of the present invention, the first pneumatic piloting means preferably includes a first solenoid direction control valve having three ports and two positions. This first solenoid direction control valve selectively and pneumatically connects the first direction control valve to one of either the air supply port or the exhaust port to pilot the first direction control valve. In addition, the second pneumatic piloting means preferably includes a second solenoid direction control valve having three ports and two positions. This second solenoid direction control valve selectively and pneumatically connects the second direction control valve to one of either the air supply port or the exhaust port to pilot the second direction control valve. In this way, the first direction control valve and the second direction control valve are each piloted independently.

Further according to the basic embodiment of the present invention, the integrable valve and position control system also preferably includes means for metering out air from the hollow cylinder. This metering out means is mounted within the complementary housing and preferably includes first means for metering out air from the full bore area of the hollow cylinder and into the first direction control valve, and preferably includes second means for metering out air from the annulus area of the hollow cylinder and into the second direction control valve. The first metering out means preferably includes a first flow control valve and a first non-return check valve pneumatically connected in parallel, and the second metering out means preferably includes a second flow control valve and a second non-return check valve pneumatically connected in parallel.

Still further according to the basic embodiment of the present invention, the complementary housing preferably includes a plurality of compartments, wherein the electronic control circuit is situated in one of the compartments, and wherein the first directional control valve and the second directional control valve are situated in another one of the compartments. Preferably, at least some of the compartments are detachable from at least one of the main housing and the complementary housing.

Finally according to the basic embodiment of the present invention, the integrable valve and position control system also preferably includes a silencer fitted within the exhaust port of the complementary housing, a first exhaust restrictor pneumatically connected between the first direction control valve and the exhaust port, a second exhaust restrictor pneumatically connected between the second direction control valve and the exhaust port, first means for manually overriding the position of the first direction control valve, and second means for manually overriding the position of the second direction control valve.

In an alternative embodiment of the present invention, the integrable valve and position control system accommodates a clamp which includes neither clamp arm position sensing means nor air pressure sensing means. To be integrable with this type of clamp, according to the alternative embodiment of the present invention, the integrable valve and position control system includes a complementary housing which is integrable with the main housing of the clamp. This complementary housing has an air supply port, an exhaust port, and an electronic interface port. In addition, the integrable valve and position control system includes means for sensing the position of the clamp arm, means for sensing the air pressure within the hollow cylinder, and a first direction control valve having three ports and two positions. This first direction control valve is capable of selectively and pneumatically connecting the full bore area of the hollow cylinder to one of either the air supply port or the exhaust port. The first direction control valve is mounted within the complementary housing. In addition to the first direction control valve, the integrable valve and position control system also includes a second direction control valve having three ports and two positions. This second direction control valve is capable of selectively and pneumatically connecting the annulus area of the hollow cylinder to one of either the air supply port or the exhaust port. The second direction control valve is mounted within the complementary housing.

According to the alternative embodiment of the present invention, the integrable valve and position control system also includes first means for pneumatically piloting the first direction control valve. This first pneumatic piloting means is mounted within the complementary housing. In addition to the first pneumatic piloting means, the integrable valve and position control system also includes second means for pneumatically piloting the second direction control valve. This second pneumatic piloting means is also mounted within the complementary housing.

Further according to the alternative embodiment of the present invention, the integrable valve and position control system also includes an electronic control circuit mounted within the complementary housing. This electronic control circuit is electrically connected to the first pneumatic piloting means, the second pneumatic piloting means, the electronic interface port, the clamp arm position sensing means, and the air pressure sensing means.

According to the alternative embodiment of the present invention, the first pneumatic piloting means preferably includes a first solenoid direction control valve having three ports and two positions. This first solenoid direction control valve selectively and pneumatically connects the first direction control valve to one of either the air supply port or the exhaust port to pilot the first direction control valve. In addition, the second pneumatic piloting means preferably includes a second solenoid direction control valve having three ports and two positions. This second solenoid direction control valve selectively and pneumatically connects the second direction control valve to one of either the air supply port or the exhaust port to thereby pilot the second direction control valve. In this way, the first direction control valve and the second direction control valve are each piloted independently.

Further according to the alternative embodiment of the present invention, the integrable valve and position control system also preferably includes means for metering out air from the hollow cylinder. This metering out means is mounted within the complementary housing and preferably includes first means for metering out air from the full bore area of the hollow cylinder and into the first direction control valve, and preferably includes second means for metering out air from the annulus area of the hollow cylinder and into the second direction control valve. The first metering out means preferably includes a first flow control valve and a first non-return check valve pneumatically connected in parallel, and the second metering out means preferably includes a second flow control valve and a second non-return check valve pneumatically connected in parallel.

Still further according to the alternative embodiment of the present invention, the complementary housing preferably includes a plurality of compartments, wherein the electronic control circuit is situated in one of the compartments, and wherein the first directional control valve and the second directional control valve are situated in another one of the compartments. Preferably, at least some of the compartments are detachable from at least one of the main housing and the complementary housing.

Finally according to the alternative embodiment of the present invention, the integrable valve and position control system also preferably includes a silencer fitted within the exhaust port of the complementary housing, a first exhaust restrictor pneumatically connected between the first direction control valve and the exhaust port, a second exhaust restrictor pneumatically connected between the second direction control valve and the exhaust port, first means for manually overriding the position of the first direction control valve, and second means for manually overriding the position of the second direction control valve. In addition, the clamp arm sensing means preferably includes either proximity switches, at least one rotary switch, or at least one absolute position linear sensor.

In an another embodiment of the present invention, the clamp is actually integrated with the valve and position control system to form a clamp with integrated valve and position control system. In such an another embodiment, the clamp includes an integrated housing having an air supply port, an exhaust port, and an electronic interface port. The clamp also includes a hollow cylinder having a first end and a second end mounted within the integrated housing, a piston movable between a first end position and a second end position within the hollow cylinder. The clamp further includes a rod connected to the piston and protruding from the second end of the hollow cylinder, defining a full bore area and an annulus area on opposite sides of the piston within the hollow cylinder. In addition, the clamp includes a linkage assembly coupled to the rod and mounted within the integrated housing, a shaft rotatably connected to the linkage assembly, a clamp arm fixedly mounted on the shaft outside of the integrated housing, means for sensing the position of the clamp arm, and means for sensing the air pressure within the hollow cylinder.

According to the another embodiment of the present invention, the clamp also includes a first direction control valve having three ports and two positions. This first direction control valve selectively and pneumatically connects the full bore area of the hollow cylinder to one of either the air supply port or the exhaust port. The first direction control valve is mounted within the integrated housing. In addition to the first direction control valve, the clamp also includes a second direction control valve having three ports and two positions. This second direction control valve selectively and pneumatically connects the annulus area of the hollow cylinder to one of either the air supply port or the exhaust port. The second direction control valve is mounted within the integrated housing.

Further according to the another embodiment of the present invention, the clamp also includes first means for pneumatically piloting the first direction control valve. This first pneumatic piloting means is mounted within the integrated housing. In addition to the first pneumatic piloting means, the clamp also includes second means for pneumatically piloting the second direction control valve. This second pneumatic piloting means is also mounted within the integrated housing. Further, the clamp also includes an electronic control circuit mounted within the integrated housing. This electronic control circuit is electrically connected to the first pneumatic piloting means, the second pneumatic piloting means, the electronic interface port, the clamp arm position sensing means, and the air pressure sensing means.

According to the another embodiment of the present invention, the first pneumatic piloting means preferably includes a first solenoid direction control valve having three ports and two positions. This first solenoid direction control valve selectively and pneumatically connects the first direction control valve to one of either the air supply port or the exhaust port to pilot the first direction control valve. In addition, the second pneumatic piloting means preferably includes a second solenoid direction control valve having three ports and two positions. This second solenoid direction control valve selectively and pneumatically connects the second direction control valve to one of either the air supply port or the exhaust port to pilot the second direction control valve. In this way, the first direction control valve and the second direction control valve are each piloted independently.

Further according to the another embodiment of the present invention, the clamp also preferably includes means for metering out air from the hollow cylinder. This metering out means is mounted within the integrated housing and preferably includes first means for metering out air from the full bore area of the hollow cylinder and into the first direction control valve, and preferably includes second means for metering out air from the annulus area of the hollow cylinder and into the second direction control valve. The first metering out means preferably includes a first flow control valve and a first non-return check valve pneumatically connected in parallel, and the second metering out means preferably includes a second flow control valve and a second non-return check valve pneumatically connected in parallel.

Still further according to the another embodiment of the present invention, the integrated housing preferably includes a plurality of compartments, wherein the electronic control circuit, the hollow cylinder, and the first directional control valve and the second directional control valve are situated in separate compartments. Preferably, at least some of the compartments are detachable from the integrated housing.

Finally according to the another embodiment of the present invention, the clamp also preferably includes a silencer fitted within the exhaust port of the integrated housing, a first exhaust restrictor pneumatically connected between the first direction control valve and the exhaust port, a second exhaust restrictor pneumatically connected between the second direction control valve and the exhaust port, first means for manually overriding the position of the first direction control valve, and second means for manually overriding the position of the second direction control valve. In addition, the clamp arm sensing means preferably includes either proximity switches, at least one rotary switch, or at least one absolute position linear sensor.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 6(*b*) is an exploded view of the integrable valve and position control system of FIG. 6(*a*)

DETAILED DESCRIPTION OF THE PREFERRED EMBODIMENTS

The preferred structures and embodiments of the integrable valve and position control system for a clamp, according to the present invention, are set forth hereinbelow. The term "integrable" as used herein means (1) that the valve and position control system may be integrated into a clamp, or (2) that the valve and position control system may be packaged with a clamp in a single piece housing, or (3) that the valve and position control system may be packaged in a separate or complementary housing which is assembled with or fastened to the clamp housing to form a single unit. As such, in a clamp network system having a plurality of clamps, each clamp has a separate valve and position control system which is located adjacent to the respective clamp.

Figure 2:
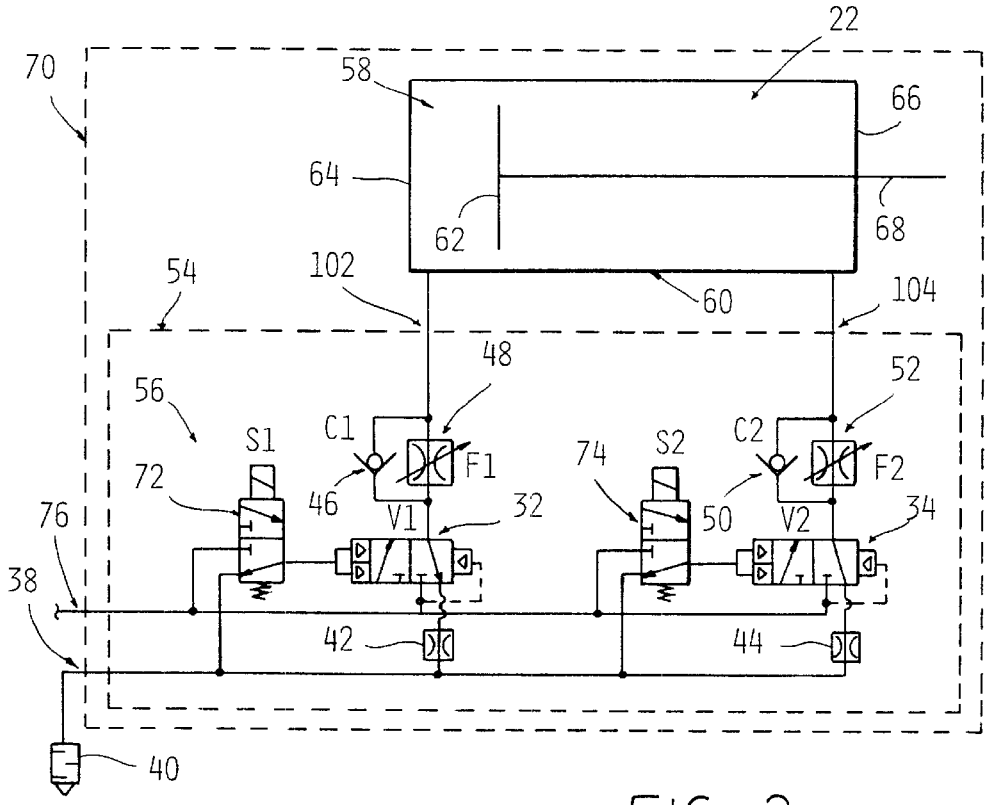
FIG. 2 is a pneumatic flow diagram representing, according to a basic embodiment of the present invention, a part of an integrable valve and position control system as such relates to a clamp.
Figure 4:
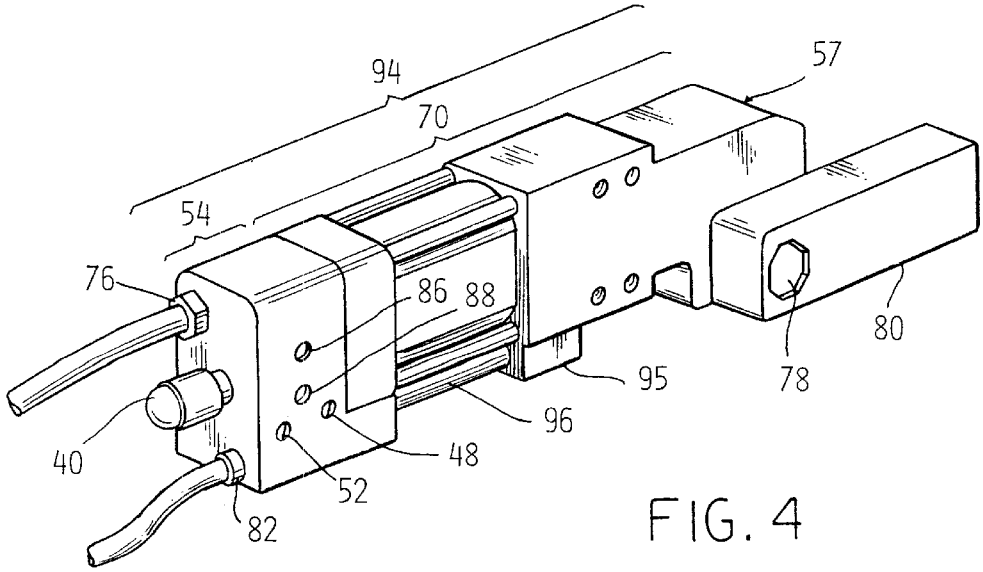
FIG. 4 is a perspective view of the integrable valve and position control device 56, according to the present invention, assembled together with the clamp 57 as a single unit 94.
Figure 5A:
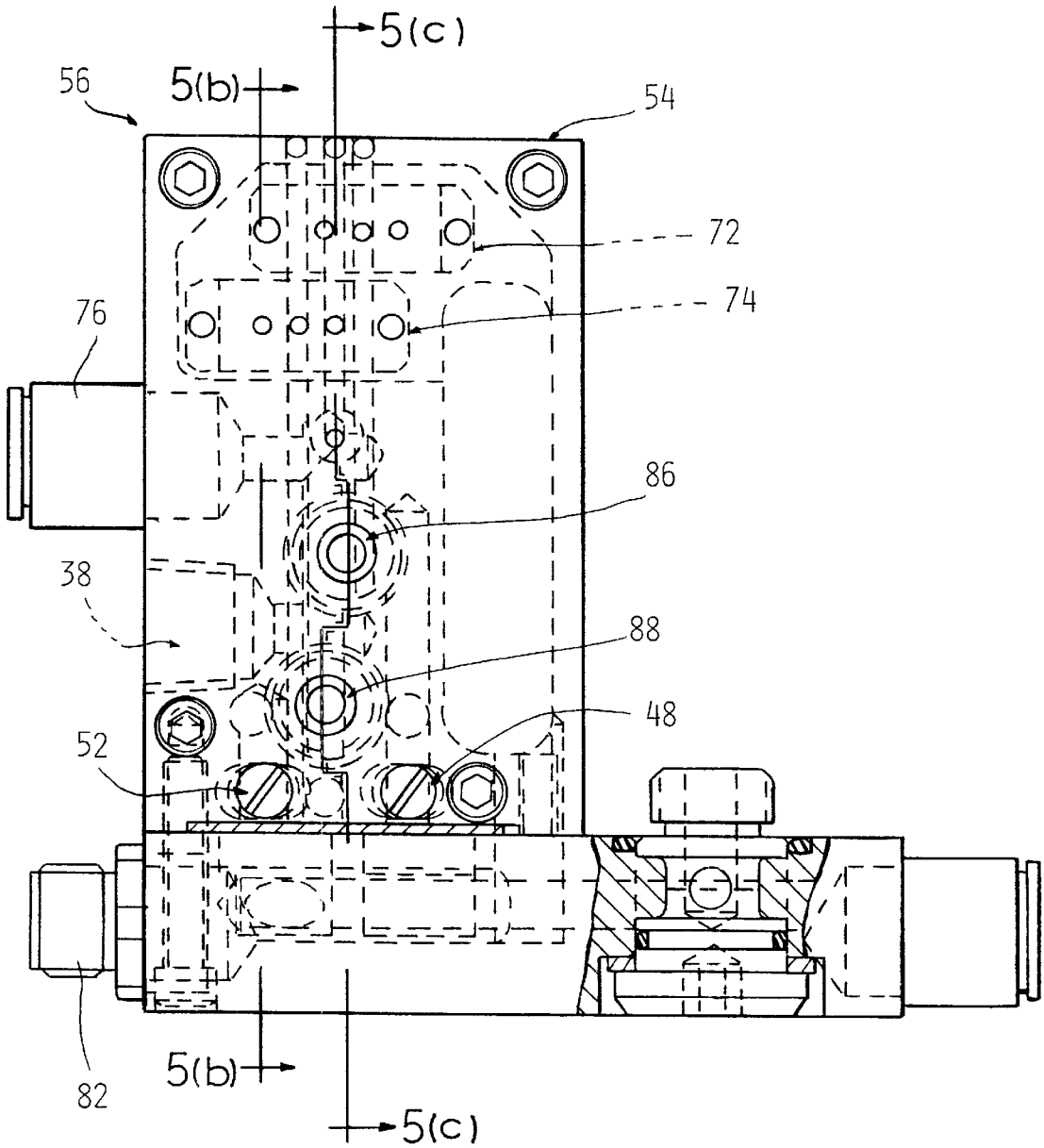
FIGS. 5(*a*)–5(*e*) include detailed cross-sectional views of the integrable valve and position control system illustrated in FIG. 4.
Figure 5C:
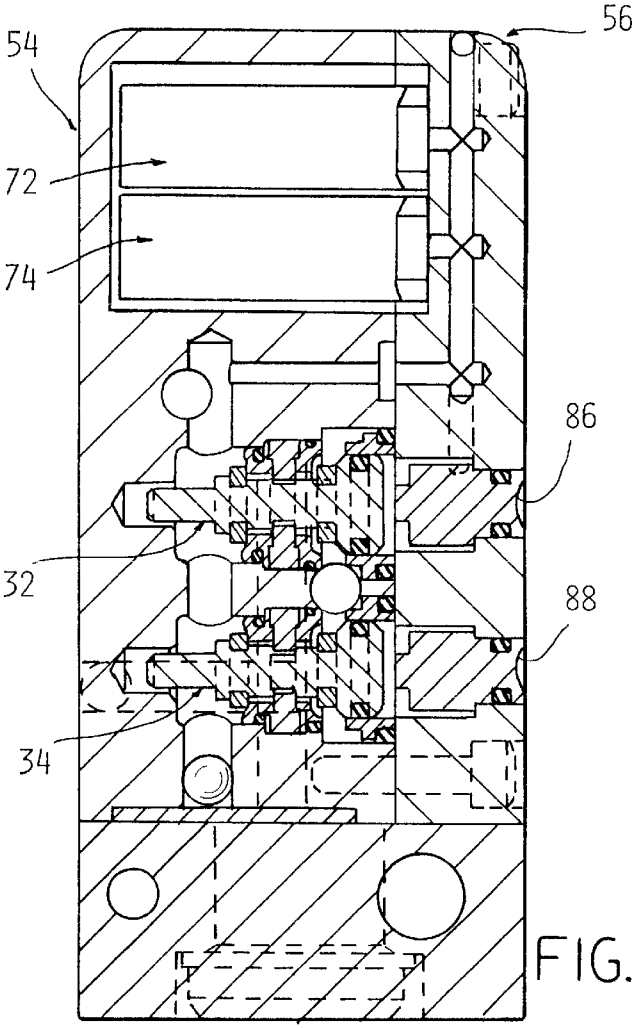
Figure 5B:
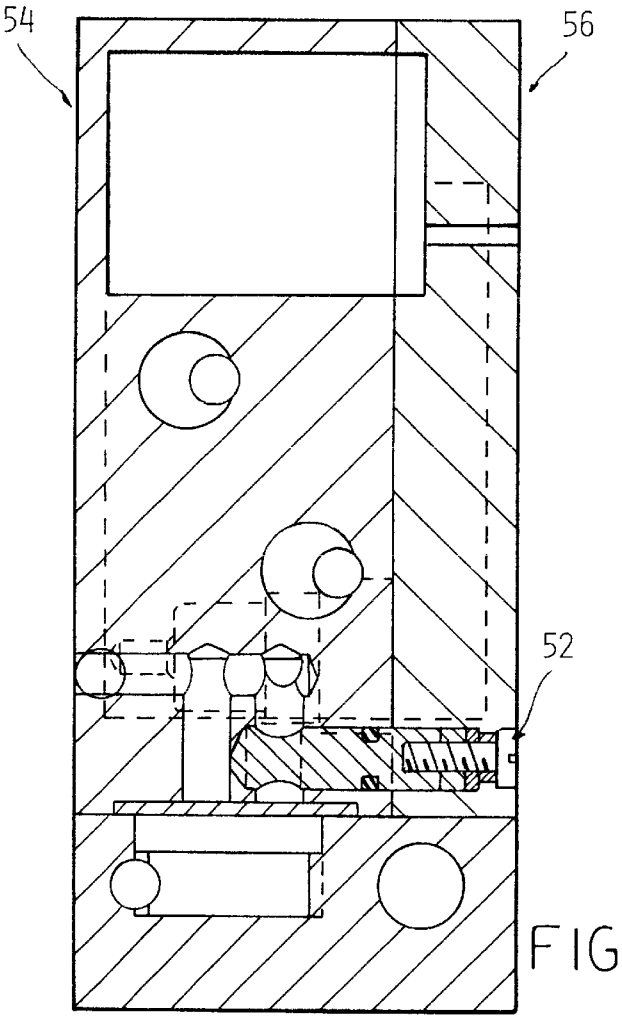
Figure 5E:
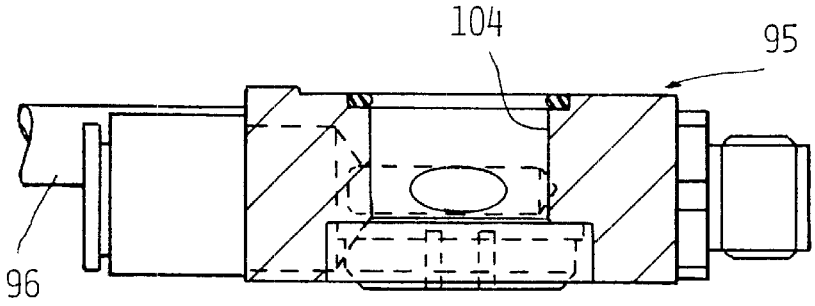

FIG. 2 is a pneumatic flow diagram representing, according to a basic embodiment of the present invention, a part of an integrable valve and position control system 56 as such relates to a clamp 57 (see also FIG. 4). In FIG. 2, therein is a hollow cylinder 60 having a first end 64 and a second end 66 mounted within a main housing 70 of a clamp. A piston 62 is movable between a first end position approximately adjacent to the first end 64 and a second end position approximately adjacent to the second end 66 within the hollow cylinder 60. A rod 68 is connected to the piston 62 and protrudes from the second end 66 of the hollow cylinder 60, defining a first chamber or full bore area 58 and a second chamber or annulus area 22 on opposite sides of the piston 62 within the hollow cylinder 60. The full bore area 58 is commonly referred to as a blind end and the annulus area 22 is commonly referred to as a rod end.

Figure 1:
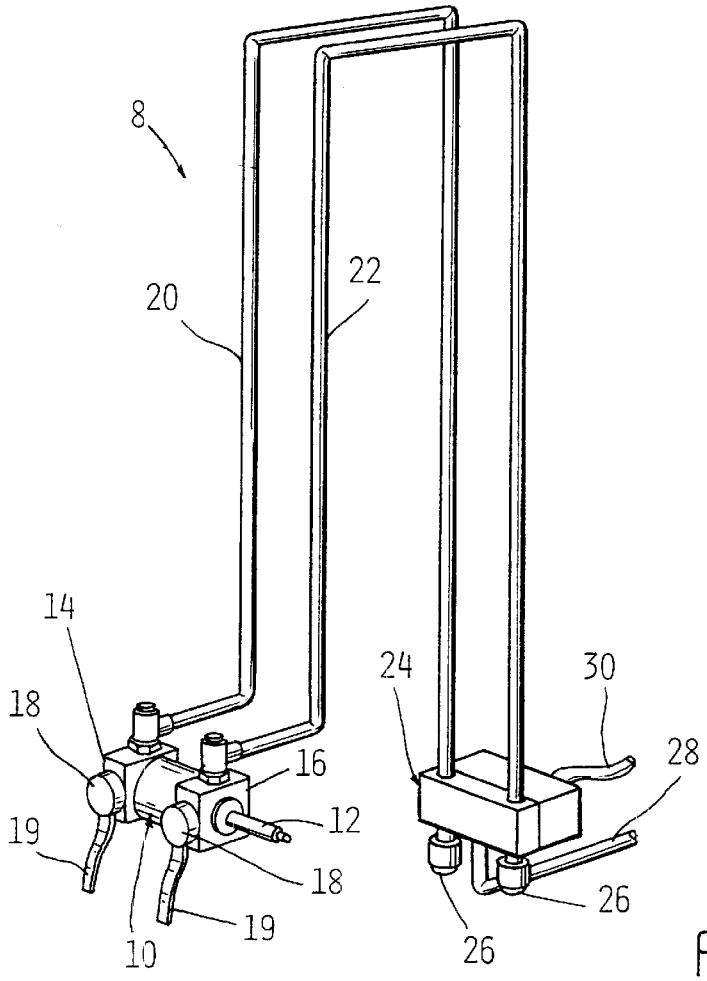
FIG. 1 PRIOR ART
FIG. 1 is a perspective view of a typical valve and cylinder system which is common in the art of industrial clamps.

Within the main housing 70, a linkage assembly (not shown) is coupled to the rod 68, and a shaft 78 (see FIG. 4) is rotatably connected to the linkage assembly. A clamp arm 80 (see FIG. 4) is fixedly mounted on the shaft 78 outside of the main housing 70. Mounted to the main housing 70 is means for sensing the position of the clamp arm 80 (see FIG. 3) and means for sensing the air pressure within the hollow cylinder 60 (see FIG. 3). The clamp arm position sensing means preferably includes either proximity switches (similar to those depicted in FIG. 1), at least one rotary switch, or at least one absolute position linear sensor. For example, the "Clamp Arm Position Sensing Apparatus" according to U.S. Pat. No. 5,875,417, by M. J. Golden, which is incorporated herein by reference in its entirety, can be utilized as the clamp arm position sensing means for purposes of the present invention. The valve and position control system 56, according to this basic embodiment of the present invention, is integrable with the above-described clamp 57.

In the basic embodiment of the present invention, the integrable valve and position control system 56 includes a complementary housing 54 which is integrable with the main housing 70 of the clamp. The complementary housing 54 has an air supply port 76, an exhaust port 38, and an electronic interface port or I/O (input/output) port 82 (see FIG. 3). In addition, the integrable valve and position control system 56 includes a first direction control valve 32 having three ports and two positions. The first direction control valve 32 is capable of selectively and pneumatically connecting the full bore area 58 of the hollow cylinder 60 to one of either the air supply port 76 or the exhaust port 38. The first direction control valve 32 is mounted within the complementary housing 54. The integrable valve and position control system 56 also includes a second direction control valve 34 having three ports and two positions. The second direction control valve 34 is capable of selectively and pneumatically connecting the annulus area 22 of the hollow cylinder 60 to one of either the air supply port 76 or the exhaust port 38. The second direction control valve 34 is also mounted within the complementary housing 54.

According to the basic embodiment of the present invention, the integrable valve and position control system 56 further includes first means for pneumatically piloting the first direction control valve 32. The first pneumatic piloting means is mounted within the complementary housing 54. The integrable valve and position control system 56 also includes second means for pneumatically piloting the second direction control valve 34. The second pneumatic piloting means is also mounted within the complementary housing 54.

Further according to the basic embodiment of the present invention, the integrable valve and position control system 56 also includes an electronic control circuit 84 (see FIG. 3) mounted within the complementary housing 54. The electronic control circuit 84 is electrically connected to the first pneumatic piloting means, the second pneumatic piloting means, and the electronic interface port 82 (see FIG. 3). In addition, the electronic control circuit 84 is also electrically connectible to the clamp arm position sensing means (see FIG. 3) and to the air pressure sensing means (see FIG. 3).

According to the basic embodiment of the present invention, the first pneumatic piloting means preferably includes a first solenoid direction control valve 72 having three ports and two positions. The first solenoid direction control valve 72 selectively and pneumatically connects the first direction control valve 32 to one of either the air supply port 76 or the exhaust port 38 to pilot the first direction control valve 32. In addition, the second pneumatic piloting means preferably includes a second solenoid direction control valve 74 having three ports and two positions. The second solenoid direction control valve 74 selectively and pneumatically connects the second direction control valve 34 to one of either the air supply port 76 or the exhaust port 38 to pilot the second direction control valve 34. In this way, the first direction control valve 32 and the second direction control valve 34 are each piloted independently.

Further according to the basic embodiment of the present invention, the integrable valve and position control system 56 also preferably includes means for metering out air from the hollow cylinder 60. This metering out means is mounted within the complementary housing 54 and preferably includes first means for metering out air from the full bore area 58 of the hollow cylinder 60 and into the first direction control valve 32, and preferably includes second means for metering out air from the annulus area 22 of the hollow cylinder 60 and into the second direction control valve 34. The first metering out means preferably includes a first flow control valve 48 and a first non-return check valve 46 pneumatically connected in parallel, and the second metering out means preferably includes a second flow control valve 52 and a second non-return check valve 50 pneumatically connected in parallel. Preferably, both the first flow control valve 48 and the second flow control valve 52 are manually adjustable.

Still further according to the basic embodiment of the present invention, the complementary housing 54 preferably includes a plurality of compartments (see FIG. 5 and FIG. 6), wherein the electronic control circuit 84 (see FIG. 3 and FIG. 6) is situated in one of the compartments, and wherein the first direction control valve 32 and the second direction control valve 34 are situated in another one of the compartments. Preferably, at least some of the compartments are detachable from at least one of the main housing 70 and the complementary housing 54 (see FIG. 4, FIG. 5, and FIG. 6).

Finally according to the basic embodiment of the present invention, the integrable valve and position control system 56 also preferably includes a silencer 40 fitted within the exhaust port 38 of the complementary housing 54, a first exhaust restrictor 42 pneumatically connected between the first direction control valve 32 and the exhaust port 38, a second exhaust restrictor 44 pneumatically connected between the second direction control valve 34 and the exhaust port 38, first means for manually overriding the position of the first direction control valve 32, and second means for manually overriding the position of the second direction control valve 34. Preferably, the first manual override means is a manually pressable first button 86 (see FIG. 4 and FIG. 5). Also, the second manual override means is preferably a manually pressable second button 88 (see FIG. 4 and FIG. 5).

In an alternative embodiment of the present invention, the integrable valve and position control system 56 accommodates a clamp 57 which includes neither clamp arm position sensing means nor air pressure sensing means. To be integrable with this type of clamp 57, according to the alternative embodiment of the present invention, the integrable valve and position control system 56 alternately includes a clamp arm position sensor 90 (see FIG. 3) and an air pressure sensor 92 (see FIG. 3) along with the features included in the above-described basic embodiment. This clamp arm position sensor 90 preferably includes either proximity switches (similar to those depicted in FIG. 1), at least one rotary switch, or at least one absolute position linear sensor. For example, the "Clamp Arm Position Sensing Apparatus" according to U.S. Pat. No. 5,875,417, by M. J. Golden, which is incorporated herein by reference in its entirety, can be utilized as the clamp arm position sensor 90 for purposes of the present invention.

In an another embodiment of the present invention, the clamp 57 is actually assembled to the valve and position control system 56. In such an another embodiment, the main housing 70 and the complementary housing 54 of the previously discussed embodiments of the present invention are fastened together to form a single unit 94 (see FIG. 4).

Figure 3:
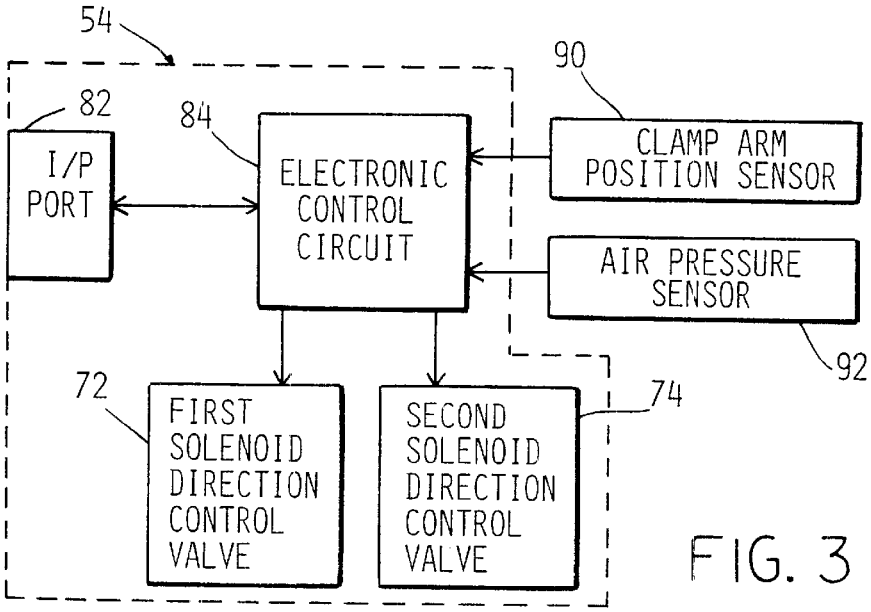
FIG. 3 is a block diagram illustrating how the electronic control circuit, according to the present invention, electronically communicates with the various electrical sensor and control components of the integrable valve and position control device and/or of the clamp.

FIG. 3 is a block diagram illustrating how the electronic control circuit 84, according to the present invention, electronically communicates with the various electrical sensor and control components of the integrable valve and position control device 56 and/or the clamp 57. In particular, the electronic control circuit 84 receives data from the clamp arm position sensor 90 and the air pressure sensor 92 to enable the electronic control circuit 84 to determine the position of the clamp arm 80 (see FIG. 4). The electronic control circuit 84 can process and respond to the received data by sending appropriate electronic control signals to the first solenoid direction control valve 72 and to the second solenoid direction control valve 74. In this way, the electronic control circuit 84 can selectively activate and utilize the first solenoid direction control valve 72 and/or the second solenoid direction control valve 74 to pilot the first direction control valve 32 and the second direction control valve 34 independently. As a result, the air pressure within the full bore area 58 and the annulus area 22 of the hollow cylinder 60 can be selectively and independently controlled to control the extension and retraction of the rod 68 as the piston 62 moves between its first end position and its second end position within the hollow cylinder 60. As the rod 68 extends and retracts, the position of the clamp arm 80 is manipulated and controlled. Furthermore, the electronic control circuit 84 can electronically communicate to an external computer network 112 (see FIG. 7) via the electronic interface port 82.

FIG. 4 is a perspective view of the integrable valve and position control device 56, according to the present invention, assembled together with the clamp 57 as a single unit 94.

FIGS. 5(*a*)–5(*e*) include detailed cross-sectional views of the integrable valve and position control system 56 illustrated in FIG. 4. FIG. 5(*a*) is a cross-sectional front view of the valve and position system 56 omitting a tie plate 95 and fastening rod 96. FIG. 5(*b*) is a cross-sectional side view of the valve and position system 56 along the lines 5(*b*)—5(*b*) in FIG. 5(*a*). FIG. 5(*c*) is a cross-sectional side view of the valve and position system 56 along the lines 5(*c*)—5(*c*) in FIG. 5(*a*). FIGS. 5(*d*)(1) and 5(*d*)(2) is a cross-sectional bottom view of the integrable valve and position control device 56 including the tie plate 95 and fastening rod 96. As best illustrated in FIG. 5(*d*)(1) and 5(*d*)(2), a first aperture 102 and a second aperture 104 permit pneumatic communication between the integrable valve and position control device system 56 and the clamp 57 when the system 56 and the clamp 57 are fastened or assembled together. FIG. 5(*e*) is a cross-sectional view of the tie plate 95 in FIG. 5(*d*)(2). As illustrated, FIG. 5 (along with FIG. 6) demonstrates the detachability of the various housings and compartments of the present invention. Such detachability is desirable, for such enables the integrable valve and position control system 56 and the clamp 57 to easily integrated and additionally enables servicing and/or replacement of the various components and modules which comprise the present invention.

Figure 6A:
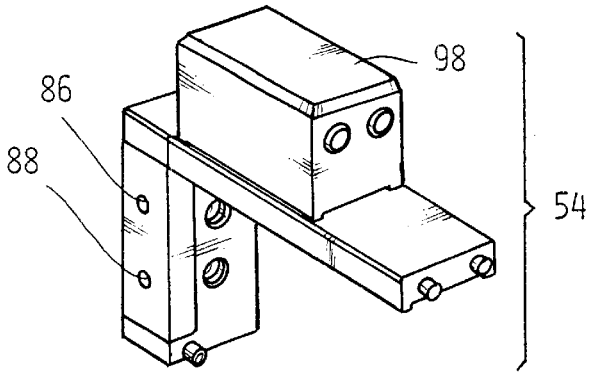
FIG. 6(*a*) is a perspective view of the integrable valve and position control system within a complementary housing.
Figure 6B:
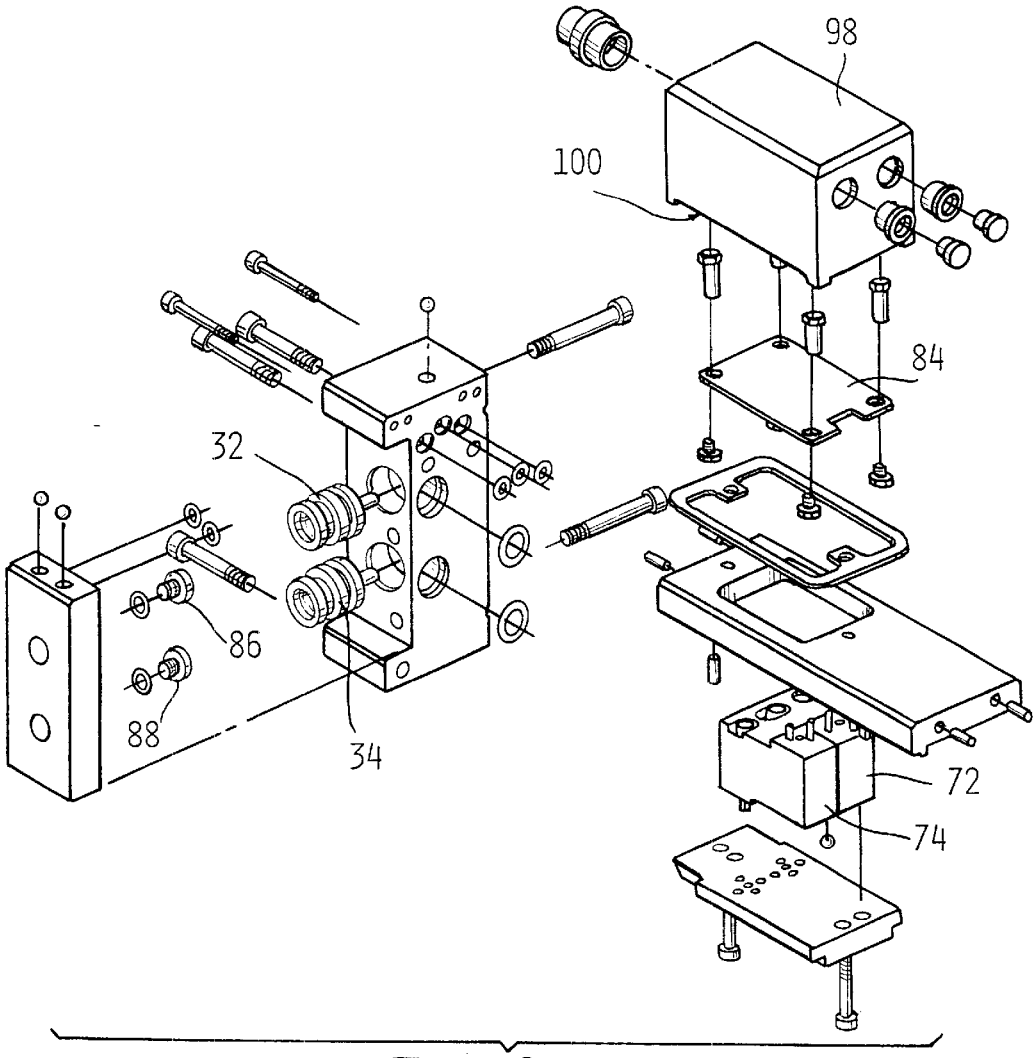

FIG. 6(*a*) is a perspective view of the integrable valve and position control system 56 within the complementary housing 54. FIG. 6(*b*) is an exploded view of the integrable valve and position control system 56. This particular embodiment of the present invention is slightly different in that the electronic control circuit 84, the first solenoid direction control valve 72, and the second solenoid direction control valve 74 are generally housed within an electrical compartment 100 separate from the first direction control valve 32 and the second direction control valve 34, all within the complementary housing 54. The electrical compartment 100 is generally defined by a cover piece 98.

Figure 7:
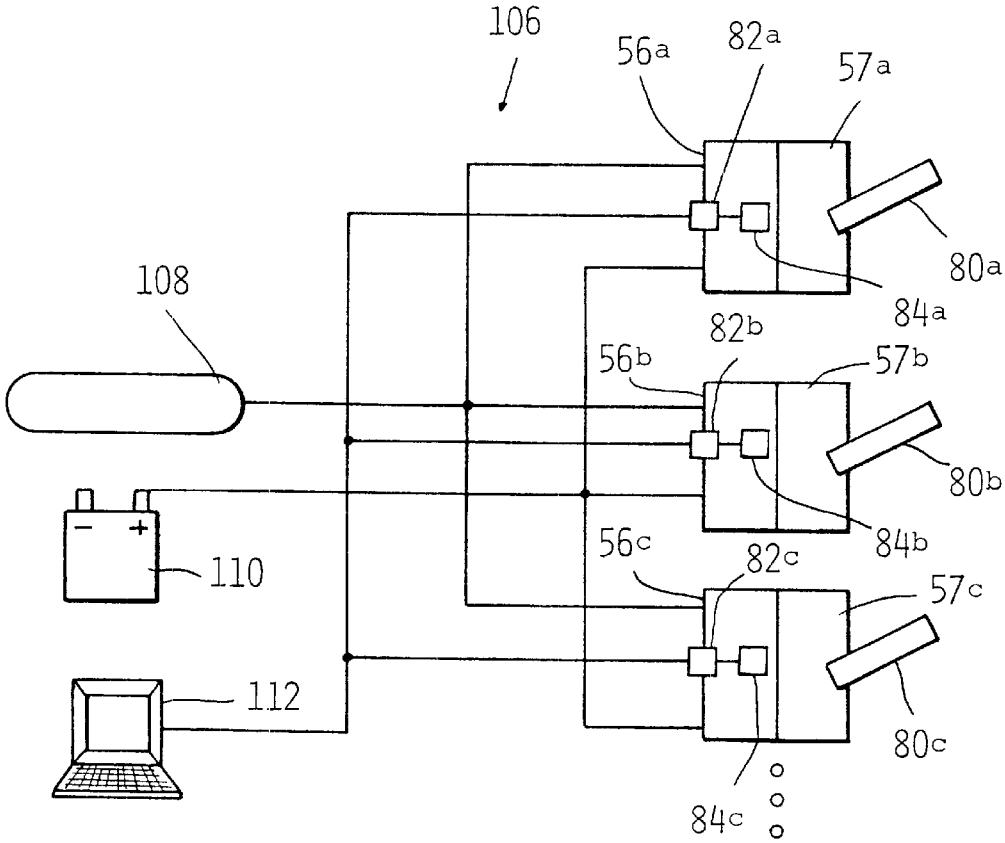
FIG. 7 is a block diagram of a clamp network system in accordance with the present invention.

FIG. 7 is a block diagram of a clamp network system 106 in accordance with the present invention. The clamp network system 106 includes a plurality of clamps 57*a*, 57*b*, and 57*c* having clamp arms 80*a*, 80*b*, and 80*c* respectively, actuated in response to pressurized air. Thus, each clamp 57*a*, 57*b*, and 57*c* is in communication with a source of air pressure 108. In accordance with the present invention, an integrable valve and control position system 56*a*, 56*b*, and 56*c* is associated with each clamp 57*a*, 57*b*, and 57*c* respectively. Each valve and control position system 56*a*, 56*b*, and 56*c* is in communication with a power source 110. The electronic control circuit 84*a*, 84*b*, and 84*c* of each valve and control position system 56*a*, 56*b*, and 56*c* respectively may also be in communication with an external computer network 112 via the electronic interface port 82*a*, 82*b*, and 82*c* respectively.

In known valve and cylinder systems, an actuator, typically a piston and a rod, is moved or stroked between first and second end limits of travel within a cylinder. The stroking of the actuator drives a clamp arm between a clamped position and a released position. Such known systems typically monitor or sense the position of the actuator only at the first and second end limits of travel. For example, the typical valve and cylinder system 8, illustrated in FIG. 2, senses the position of the piston 62 only at the first and second end limits of travel 14 and 16 with proximity sensors 18. In this manner, the clamped position is associated with one end limit of travel and the released position is associated with the opposite end limit of travel. As a result, the clamp arm in known valve and cylinder systems has predetermined clamped and released positions.

Unlike the prior art, the present invention includes means for selectively setting at least one of the clamped position and the released position at an actuator position between the first and second end limits of travel of the actuator. To selectively set the clamped and/or released positions, the present invention further includes means for sensing the position of the clamp arm 80, actuator 62, and/or the shaft 78 operably connecting the actuator 62 and the clamp arm 80 as well as means for controlling the movement of the actuator 62. The present invention includes means for sensing the position of the clamp arm 80 such as a rotary position sensor, means for sensing the position of the actuator 62 such as an absolute linear position sensor, and/or means for sensing the position of the shaft 78 such as a rotary position sensor.

Within the present invention, the actuator 62 is moved in response to differential air pressure in first and second chambers 58 and 22 located on opposite sides of the actuator 62. Thus, to control the movement of the actuator 62, the present invention includes means for adjusting the air pressure in the first and second chambers 58 and 22.

To adjust the air pressure in the first and second chambers 58 and 22, the present invention includes means for sensing air pressure in the first and second chambers 58 and 22, means for supplying pressurized air to the first and second chambers 58 and 22, and means for exhausting pressurized air from the first and second chambers 58 and 22.

Using the means for sensing the position of the clamp arm 80, actuator 62, and/or shaft 78 as well as means for controlling the movement of the actuator 62, the electronic control circuit 84 can be programmed to select the clamped and release positions for each specific application of the clamp 57. Selecting an application specific clamped and/or released position decreases the cycle time of the clamp 57 and, thus, increases operation throughput.

In some known clamp network system applications the operation of a first clamp can interfere with the operation of a second clamp and, thus, the first clamp needs to be opened or closed before the second clamp is operated. Using the position sensing means, the electronic control circuit 84 can determine when the first clamp has cleared the path of the second clamp and activate the second clamp before the first clamp reaches either the clamped or released position.

Within the present invention, the electronic control circuit 84 includes means for calculating the speed of actuator movement. Using the position sensing means, the means for controlling the movement of the actuator 62, and such actuator speed calculation means, the electronic control circuit 84 can be programmed to selectively control the speed of actuator movement as the actuator 62 moves between the first and second end limits of travel. Preferably, the electronic control circuit 84 can be programmed to selectively control the speed of actuator movement as the actuator 62 approaches at least one of the first and second end limits of travel to provide a soft touch clamp action.

In some prior art systems, one valve is used to control two or more clamps at different remote locations.

In this type of prior art valve and cylinder system, each pair of air lines connecting each clamp to the single valve may have a different length and/or a different route (or, in other words, each pair of air lines may have a different number of bends and/or vertical displacements along the length of the air line). Accordingly, the time it takes for pressurized air to reach each clamp varies. As a result, substantial adjustment or tweaking of each clamp is necessary to operate (i.e. open and close) all the clamps either simultaneously or in a predetermined sequence. By locating the valve and position control system 54 adjacent to the respective clamp 57, the electronic control circuit 84 can be programmed to precisely operate the respective clamp 57 and eliminate such concerns.

In light of the above, the present invention eliminates many, if not all, of the drawbacks and prior art problems associated with the cylinder and the air valve system being remotely located from each other. The present invention does so by making the air valve system integrable with the cylinder associated with the clamp 57.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An integrable valve and position control system for a clamp having a main housing, a hollow cylinder having a first end and a second end mounted within said main housing, a piston movable between a first end position and a second end position within said hollow cylinder, a rod connected to said piston and protruding from said second end of said hollow cylinder defining a full bore area and an annulus area on opposite sides of said piston within said hollow cylinder, a linkage assembly coupled to said rod and mounted within said main housing, a shaft rotatably connected to said linkage assembly, a clamp arm fixedly mounted on said shaft outside of said main housing, means for sensing the position of said clamp arm, means for sensing the air pressure within said hollow cylinder, said integrable valve and position control system comprising:

a complementary housing integrable with said main housing of said clamp, said complementary housing having an air supply port, an exhaust port, and an electronic interface port;

a first direction control valve having three ports and two positions, said first direction control valve capable of selectively and pneumatically connecting said full bore area of said hollow cylinder to one of said air supply port and said exhaust port, said first direction control valve mounted within said complementary housing;

a second direction control valve having three ports and two positions, said second direction control valve capable of selectively and pneumatically connecting said annulus area of said hollow cylinder to one of said air supply port and said exhaust port, said second direction control valve mounted within said complementary housing;

first means for pneumatically piloting said first direction control valve, said first pneumatic piloting means mounted within said complementary housing;

second means for pneumatically piloting said second direction control valve, said second pneumatic piloting means mounted within said complementary housing; and an electronic control circuit mounted within said complementary housing, said electronic control circuit electrically connected to said first pneumatic piloting means, said second pneumatic piloting means, and said electronic interface port, said electronic control circuit electrically connectible to said clamp arm position sensing means and to said air pressure sensing means.

2. The integrable valve and position control system according to claim 1, said integrable valve and position control system further comprising a silencer fitted within said exhaust port of said complementary housing.

3. The integrable valve and position control system according to claim 1, wherein said first pneumatic piloting means comprises a first solenoid direction control valve having three ports and two positions, said first solenoid direction control valve selectively and pneumatically connecting said first direction control valve to one of said air supply port and said exhaust port to pilot said first direction control valve.

4. The integrable valve and position control system according to claim 3, wherein said second pneumatic piloting means comprises a second solenoid direction control valve having three ports and two positions, said second solenoid direction control valve selectively and pneumatically connecting said second direction control valve to one of said air supply port and said exhaust port to pilot said second direction control valve.

5. The integrable valve and position control system according to claim 1, said integrable valve and position control system further comprising means for metering out air from said hollow cylinder, wherein said metering out means is mounted within said complementary housing.

6. The integrable valve and position control system according to claim 5, wherein said metering out means comprises:

first means for metering out air from said full bore area of said hollow cylinder and into said first direction control valve; and second means for metering out air from said annulus area of said hollow cylinder and into said second direction control valve.

7. The integrable valve and position control system according to claim 6, wherein said first metering out means comprises a first flow control valve and a first non-return check valve pneumatically connected in parallel, and wherein said second metering out means comprises a second flow control valve and a second non-return check valve pneumatically connected in parallel.

8. The integrable valve and position control system according to claim 1, said integrable valve and position control system further comprising:

a first exhaust restrictor pneumatically connected between said first direction control valve and said exhaust port; and a second exhaust restrictor pneumatically connected between said second direction control valve and said exhaust port.

9. The integrable valve and position control system according to claim 1, said integrable valve and position control system further comprising:

first means for manually overriding the position of said first direction control valve; and second means for manually overriding the position of said second direction control valve.

10. The integrable valve and position control system according to claim 1, wherein said complementary housing comprises a plurality of compartments.

11. The integrable valve and position control system according to claim 10, wherein said electronic control circuit is situated in one of said plurality of compartments, and wherein said first directional control valve and said second directional control valve are situated in another of said plurality of compartments.

12. The integrable valve and position control system according to claim 10, wherein at least some of said plurality of compartments are detachable from at least one of said main housing and said complementary housing.

13. A valve system for controlling an actuator including a piston movable within a housing and defining first and second chambers, the valve system comprising:

first means for selectively controlling a flow of a first fluid stream relative to the first chamber;

second means for selectively controlling a flow of a second fluid stream relative to the second chamber, the first and second controlling means operable to control the first and second fluid streams independent of one another;

a clamp member movable along a path between a clamped position and a released position in response to movement of the piston;

a first sensor for sensing at least one position of the member along the path; and an electronic control circuit operably associated with the actuator for controlling a speed of movement of the clamp member along the path with the first and second controlling means.

14. The valve system according to claim 13 wherein the first controlling means further comprises:

a three-way valve in fluid communication with the first chamber moveable between a first position and a second position to expand and contract the first chamber respectively.

15. The valve system according to claim 14 wherein first controlling means further comprises:

means for biasing the three-way valve toward the second position.

16. The valve system according to claim 19 wherein first controlling means further comprises:

a check valve positionable between the three-way valve and the first chamber for preventing contraction of the first chamber; and a flow valve positionable between the three-way valve and the first chamber for selectively controlling a rate of expansion and contraction of the first chamber.

17. The valve system according to claim 14 wherein first controlling means further comprises:

fluid restricting means positionable between the three-way valve and an exhaust manifold for limiting a rate of contraction of the first chamber.

18. The valve system according to claim 14 wherein first control means further comprises:

means for biasing the three-way valve toward the second position; and drive means for moving the three-way valve to the first position against the urging of the biasing means.

19. The valve system according to claim 18 wherein moving means further comprises:

a pilot valve operably associated with the three-way valve movable between a first position corresponding to the first position of the three-way valve and a second position corresponding to the second position of the three-way valve.

20. The valve system according to claim 19 further comprising:

means for biasing the pilot valve to the second position of the pilot valve.

21. The valve system according to claim 13 further comprising:

a housing mountable with respect to the actuator for enclosing the first and second controlling means.

22. The valve system according to claim 21 further comprising:

a silencer mountable with respect to the housing and operably associated with first and second controlling means for receiving the first and second fluid streams when the first and second chambers are contracted.

23. The valve system according to claim 13 further comprising:

a second sensor for sensing a fluid pressure in at least one of the first and second chambers.

24. The valve system of claim 13 further comprising:

the electronic control means for selectively setting one of a starting position and an ending position of movement of the piston within the housing with the first and second controlling means.

25. The valve system of claim 13 further comprising:

the electronic control means for sensing a fluid pressure internal with respect to at least one of the first and second chambers with a second sensor.

26. A method for controlling an actuator including a piston moveable within a housing and defining first and second chambers, the method comprising the steps of:

selectively controlling a flow of a first fluid stream relative to the first chamber with first controlling means;

selectively controlling a flow of a second fluid stream relative to the second chamber with second controlling means, the first and second controlling means operable to control the first and second fluid streams independent of one another;

moving a member along a path in response to movement of the piston; sensing a position of the member along the path with a first sensor; and controlling a speed of movement of the member along the path with the first and second controlling means.

27. The method according to claim 26 further comprising the step of:

sensing a fluid pressure internal with respect to at least one of the first and second chambers with a second sensor.

28. The method according to claim 26 further comprising the step of:

enclosing the first and second controlling means in a housing; and engaging the housing with respect to the actuator.

29. A method for controlling an actuator including a piston moveable within a housing and defining first and second chambers, the method comprising the steps of:

selectively controlling a flow of a first fluid stream relative to the first chamber with first controlling means;

selectively controlling a flow of a second fluid stream relative to the second chamber with second controlling means, the first and second controlling means operable to control the first and second fluid streams independent of one another;

moving a member along a path in response to movement of the piston;

sensing a position of the member along the path with a first sensor; and selectively setting one of a starting position and an ending position of movement of the member along the path with the first and second controlling means.

30. A valve system for controlling an actuator including a piston movable within a housing and defining first and second chambers, the valve system comprising:

first means for selectively controlling a flow of a first fluid stream relative to the first chamber, first controlling means having a three-way valve in fluid communication with the first chamber movable between a first position and a second position to expand and contract the first chamber respectively;

second means for selectively controlling a flow of a second fluid stream relative to the second chamber, second controlling means having a second three-way valve in fluid communication the second chamber movable between a third position and a fourth position to expand and contract the second chamber respectively, the first and second controlling means operable to control the first and second fluid streams independent of one another;

a clamp member movable along a path between a clamped position and a released position in response to movement of the piston; and an electronic control circuit operably associated with the actuator for sensing at least one position of the clamp member along the path with a first sensor, and for sensing a fluid pressure internal with respect to at least one of the first and second chambers with a second sensor.

31. The valve system according to claim 30 further comprising:

a housing mountable with respect to the actuator for enclosing the first and second controlling means.

32. The valve system according to claim 30 further comprising:

a pilot valve operably associated with the three-way valve moveable between a first position corresponding to the first position of the three-way valve and a second position corresponding to the second position of the three-way valve.

33. The valve system of claim 30 further comprising:

the electronic control means for selectively setting one of a starting position and an ending position of the piston within the housing with the first and second control means.

34. The valve system of claim 30 further comprising:

the electronic control means for controlling the speed of movement of the piston within the housing with the first and second control means.

35. A method for controlling an actuator including a piston moveable within a housing and defining first and second chambers, the method comprising the steps of:

selectively controlling a flow of a first fluid stream relative to the first chamber with first controlling means including a three-way valve in fluid communication with the first chamber moveable between a first position and a second position to expand and contract the first chamber respectively; and selectively controlling a flow of a second fluid stream relative to the second chamber with second controlling means including a second three-way valve in fluid communication the second chamber moveable between a third position and a fourth position to expand and contract the second chamber respectively, the first and second controlling means operable to control the first and second fluid streams independent of one another;

moving a member along a path in response to movement of the piston;

sensing a position of the member along the path with a first sensor; and sensing a fluid pressure internal with respect to at least one of the first and second chambers with a second sensor;

36. The method according to claim 35 further comprising the steps of:

controlling a speed of movement of the member along the path with the first and second control means in response to at least one of the sensed position and the sensed pressure; and selectively setting one of a starting position and an ending position of the member along the path with the first and second control means.

37. A valve system for controlling an actuator including a piston movable within a housing and defining first and second chambers, the valve system comprising:

at least one flow controlling means for selectively controlling flow of a fluid stream relative to at least one of the first and second chambers;

an electronic control circuit operably associated with actuator for controlling movement of the piston within the housing with the at least one flow controlling means; and position sensor means for sensing a position of the piston within the housing.

38. The valve system of claim 37 further comprising:

the electronic control circuit for selectively controlling speed of the piston as the piston moves between first and second end limits of travel within the housing.

39. The valve system of claim 37 further comprising:

the electronic control circuit for selectively setting at least one of a start position and a stop position corresponding to a position of the piston located between first and second end limits of travel of the piston within the housing.

40. The valve system of claim 37 further comprising:

the electronic control circuit for selectively controlling speed of the piston as the piston approaches at least one of first and second end limits of travel within the housing to provide a soft touch action.

41. The valve system of claim 37 further comprising:

the electronic control circuit for connecting to an electronic interface port for integration into a computerized control network.

42. The valve system of claim 37 further comprising:

the electronic control circuit for calculating the speed of the piston moving within the housing.

43. The valve system of claim 37 further comprising:

the electronic control circuit for selectively adjusting pressurized fluid within the first and second chambers independently of one another.

44. The valve system of claim 37 further comprising:

a plurality of clamps, each clamp having separate electronic control circuits and at least one separate flow controlling means, each electronic control circuit interconnected with respect to one another through a common central computerized control network.

45. The valve system of claim 37 further comprising:

an enclosure;

each of the flow controlling means mounted within the enclosure; and the electronic control circuit mounted within the enclosure.

46. The valve system of claim 45 further comprising:

the enclosure complementary with respect to the housing of the piston and mountable to the housing.

47. The valve system of claim 45 further comprising:

the enclosure formed integral with the housing of the piston.

48. The valve system of claim 45 further comprising;

fluid pressure sensor means mounted within the enclosure for sensing the fluid pressure in at least one of the first and second chambers.

49. The valve system of claim 45 further comprising:

position sensor means mounted within the enclosure for sensing a position of the piston within the housing.

50. The valve system of claim 37 further comprising:

fluid pressure sensor means for sensing the fluid pressure in at least one of the first and second chambers.

51. The valve control system of claim 37 further comprising:

a clamp having at least one clamp arm moveable between a clamped position and a released position in response to movement of the piston between first and second end limits of travel within the housing; and the electronic control circuit for selectively setting at least one of the clamped position and the released position at a position of the piston between the first and second end limits of travel of the piston within the housing.

52. The valve system of claim 51 further comprising:

means for sensing a position of at least one of the clamp arm and the piston.

53. The valve system of claim 53, wherein the sensing means further comprises a rotary position sensor.

54. The valve system of claim 52, wherein the sensing means further comprises an absolute linear position sensor.

55. The valve system of claim 37, wherein the flow controlling means further comprises:

a source of pressurized fluid; and at least one control valve for selectively communicating one of the first and second chambers with the source of pressurized fluid and for selectively exhausting pressurized fluid from the other of the first and second chambers.

56. The valve system of claim 37, wherein the flow controlling means further comprises:

a first 3-way valve having a first port connected to the first chamber, a second port connected to pressurized fluid, and a third port connected to an exhaust port; and a second 3-way valve having a first port connected to the second chamber, a second port connected to pressurized fluid, and a third port connected to an exhaust port.

* * * * *